US009750329B1

(12) United States Patent
Pinholster, Jr. et al.

(10) Patent No.: US 9,750,329 B1
(45) **Date of Patent: *Sep. 5, 2017**

(54) MULTIPLE-LOOP SUPPORT STRAP AND METHOD FOR HANGING A HAMMOCK

(71) Applicant: Eagles Nest Outfitters, Inc., Asheville, NC (US)

(72) Inventors: Peter G. Pinholster, Jr., Asheville, NC (US); Brendan Garvey, Asheville, NC (US)

(73) Assignee: Eagles Nest Outfitters, Inc., Asheville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/490,735

(22) Filed: Apr. 18, 2017

Related U.S. Application Data

(63) Continuation of application No. 15/138,853, filed on Apr. 26, 2016, now Pat. No. 9,622,566, which is a continuation of application No. 14/685,920, filed on Apr. 14, 2015, now Pat. No. 9,320,343, which is a continuation of application No. 13/455,684, filed on Apr. 25, 2012, now Pat. No. 9,003,579.

(51) Int. Cl.
*A45F 3/24* (2006.01)
*A45F 3/22* (2006.01)

(52) U.S. Cl.
CPC . *A45F 3/24* (2013.01); *A45F 3/22* (2013.01)

(58) Field of Classification Search
CPC ... A45F 3/22; A45F 3/24; A62B 35/00; A62B 35/0068; A63B 27/00; A63B 27/02; A63B 27/04
USPC ..... 5/120, 127; 182/9; D8/349, 356
See application file for complete search history.

(56) References Cited

U.S. PATENT DOCUMENTS 3,233,851 A * 2/1966 Lemieux ..... H02G 3/0437 248/68.1
3,483,575 A * 12/1969 McCarthy ..... A45F 4/02 2/69.5
3,998,367 A * 12/1976 Harding ..... F41B 5/1461 124/23.1
D261,960 S * 11/1981 Mathews ..... D8/356
4,319,428 A * 3/1982 Fox ..... A01G 17/04 24/115 H
4,405,034 A * 9/1983 Dunne ..... B63B 27/14 182/100
5,209,712 A * 5/1993 Ferri ..... A61H 1/02 482/131
5,293,657 A * 3/1994 DeAth ..... A62B 35/0068 182/9

(Continued)

*Primary Examiner* — Robert G Santos
(74) *Attorney, Agent, or Firm* — Schwartz Law Firm, P.C.

(57) ABSTRACT

A multiple-look support strap is adapted for hanging one end of a hammock from a fixed structure. The support strap cooperates with a like strap to hang an opposite end of the hammock from a second fixed structure spaced apart from the first. The support strap comprises an elongated length of flexible strap folded upon itself to form first and second overlying strap sections. The strap sections are integrally joined together at a first end of the support strap, and a least one of the first and second strap sections terminates at an opposite second end of the support strap. A plurality of strap loops are formed with the first and second strap sections between opposite ends of the support strap.

8 Claims, 4 Drawing Sheets

(56) References Cited

U.S. PATENT DOCUMENTS 5,308,101 A * 5/1994 Monty ..... B60D 1/182 267/74
5,579,548 A * 12/1996 Death ..... A45F 3/24 5/120
5,688,011 A * 11/1997 Gulley ..... B66C 1/18 294/74
D388,558 S * 12/1997 Miller ..... D30/153
D418,301 S * 1/2000 Anderson ..... D3/327
D454,235 S * 3/2002 Kaplan ..... D30/153
6,357,551 B1 * 3/2002 Bogardus, III ..... E06C 1/56 182/190
6,981,571 B2 * 1/2006 Diggle ..... A63B 27/00 182/133
D573,381 S * 7/2008 Pinholster, Jr. ..... D6/387
D580,257 S * 11/2008 Squyres ..... D8/349
7,585,197 B1 * 9/2009 Merten ..... B63C 9/26 182/136
D661,175 S * 6/2012 Dahl ..... D8/349
D666,896 S * 9/2012 Pinholster, Jr. ..... D8/356
8,381,876 B1 * 2/2013 Darden ..... A63B 27/02 182/136
8,443,471 B2 * 5/2013 McCurdy ..... D07B 1/02 5/120
8,505,683 B1 * 8/2013 Dirrig ..... A63B 27/00 182/9
8,567,018 B2 * 10/2013 Dahl ..... D07B 1/18 24/300
8,590,116 B2 * 11/2013 Dahl ..... D07B 1/18 24/300
D712,555 S * 9/2014 Berg ..... D24/190
8,920,084 B2 * 12/2014 Dahl ..... D07B 1/18 410/96
8,944,976 B2 * 2/2015 Crowell ..... A63B 21/0442 482/121
9,003,579 B1 * 4/2015 Pinholster, Jr. ..... A45F 3/24 5/120
9,150,999 B2 * 10/2015 Dahl ..... D07B 1/18
9,151,358 B2 * 10/2015 Dahl ..... D07B 1/18
9,222,218 B2 * 12/2015 Dahl ..... D07B 1/18
9,320,343 B1 * 4/2016 Pinholster, Jr. ..... A45F 3/24
9,622,566 B1 * 4/2017 Pinholster, Jr. ..... A45F 3/24
2004/0215114 A1 * 10/2004 Cruz ..... A61H 11/00 601/132
2011/0154797 A1 * 6/2011 Dahl ..... D07B 1/18 57/200
2011/0158760 A1 * 6/2011 Dahl ..... D07B 1/18 410/96
2012/0060278 A1 * 3/2012 McCurdy ..... D07B 1/02 5/120
2012/0174555 A1 * 7/2012 Dahl ..... D07B 1/18 57/201
2013/0157821 A1 * 6/2013 Crowell ..... A63B 21/0442 482/129
2014/0017024 A1 * 1/2014 Dahl ..... D07B 1/18 410/96
2014/0072383 A1 * 3/2014 Dahl ..... D07B 1/18 410/96
2014/0137532 A1 * 5/2014 Dahl ..... D07B 1/18 57/243
2017/0127808 A1 * 5/2017 Conlin ..... A45F 3/24

* cited by examiner

Fig. 3
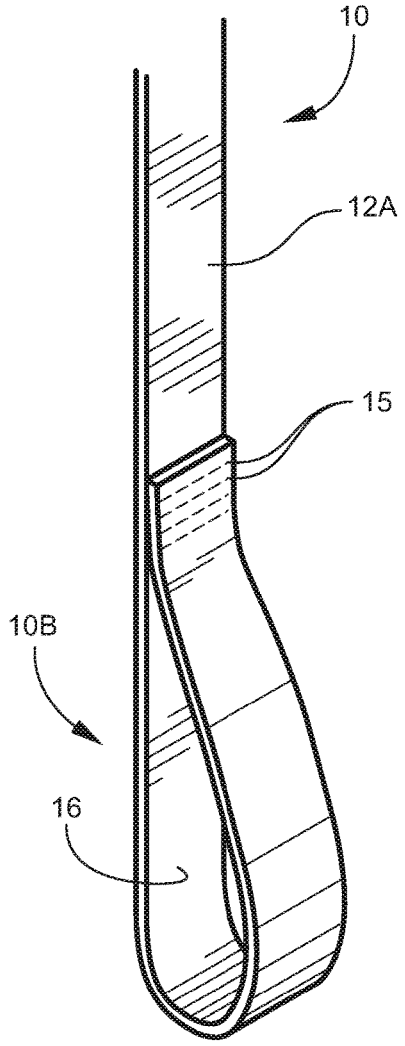
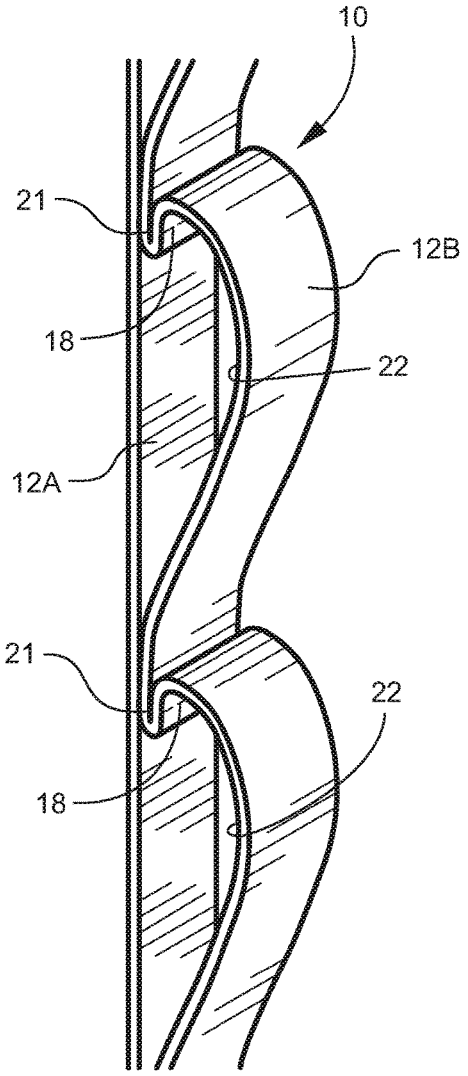
Fig. 4

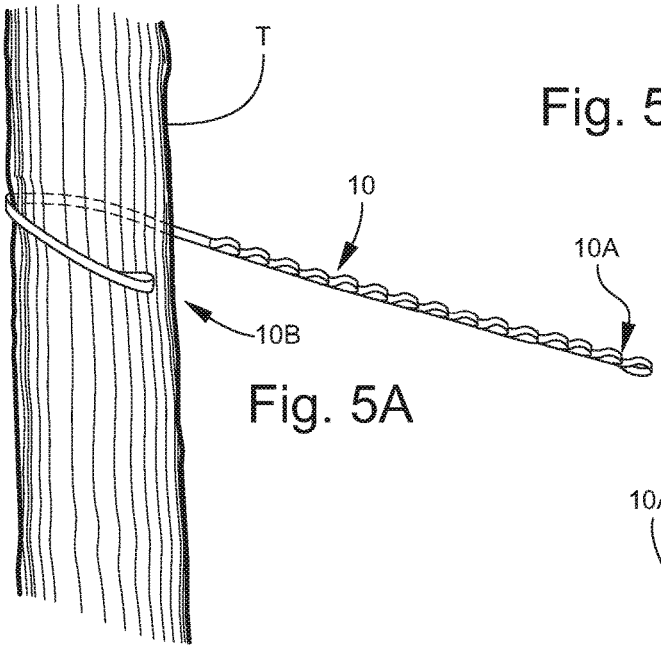
Fig. 5A
Fig. 5B
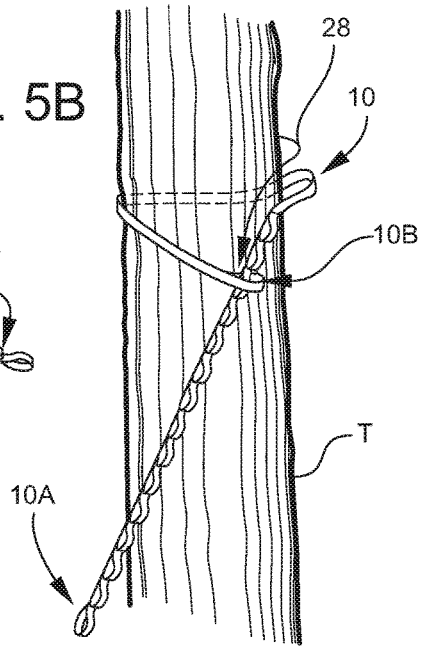
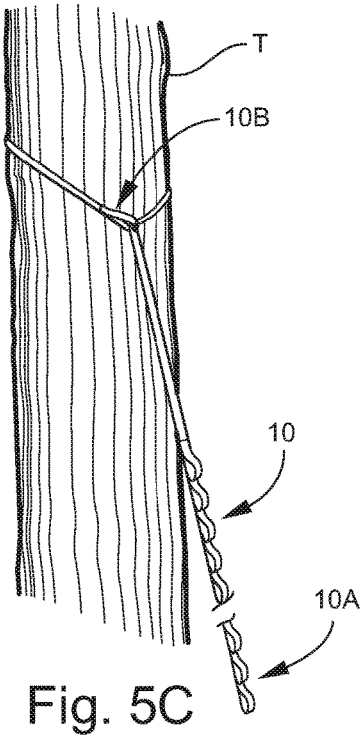
Fig. 5C
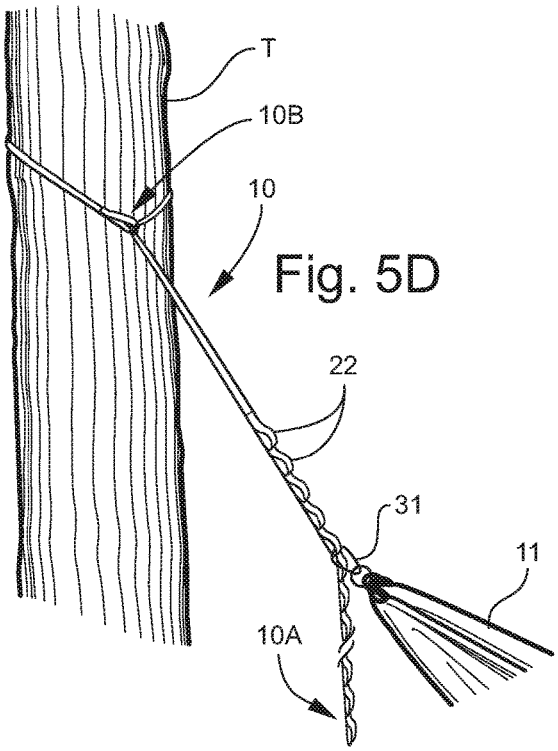
Fig. 5D

MULTIPLE-LOOP SUPPORT STRAP AND METHOD FOR HANGING A HAMMOCK

TECHNICAL FIELD AND BACKGROUND OF THE INVENTION

This invention relates broadly and generally to utility support strap; and in various exemplary embodiments discuss herein, to a multiple-loop support strap and method for hanging a hammock.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a multiple-look support strap adapted for hanging (or suspending) one end of a hammock from an upright fixed structure. In one implementation, the present support strap cooperates with a like strap to hang an opposite end of the hammock from a second upright fixed structure spaced apart (e.g., 10-20 feet) from the first. The exemplary support strap comprises an elongated length of flexible strap folded upon itself to form first and second overlying strap sections. The strap sections are integrally joined together at a first end of the support strap, and a least one of the first and second strap sections terminates at an opposite second end of the support strap. Means are provided for attaching the first and second strap sections together at a plurality of longitudinally-spaced attachment points, such that adjacent attachment points define a single strap loop therebetween. A plurality of strap loops may be formed with the first and second strap sections.

The term "loop" refers broadly herein to a portion or portions of the first and/or second straps folded or doubled upon itself so as to leave an opening between the overlying parts.

According to another exemplary embodiment, the first strap section is longer than the second strap section.

According to another exemplary embodiment, a free end of the first strap section is folded and attached to define a single end loop at the second end of the support strap.

According to another exemplary embodiment, the attachment points are substantially equally spaced apart, such that respective openings defined by the plurality of loops are of substantially equal size.

According to another exemplary embodiment, the plurality of strap loops comprises greater than 8 strap loops.

According to another exemplary embodiment, the plurality of strap loops comprises greater than 12 strap loops.

According to another exemplary embodiment, the means for attaching the first and second strap sections together comprises a machine-sewn upholstery thread. Alternative attachment means may comprise, for example, ultrasonic bonding or welding, contact cement or other adhesive, hardware fasteners, hook and loop fasteners, or the like.

According to another exemplary embodiment, the flexible strap comprises flat polyester webbing. Alternatively, the flexible strap may comprise polypropylene, nylon, or other flexible webbing material suitable for carrying heavy loads, with relatively low stretch, and having generally high abrasion and UV protection.

According to another exemplary embodiment, a free end of the second strap section is attached to the first strap section at a final attachment point. In this embodiment, a length of the support strap measured from its first end to the final attachment point is less than 80 percent of the total length of said support strap.

In another exemplary embodiment, the present disclosure comprises a method for hanging an end of a hammock from an upright fixed structure. The method includes wrapping an elongated flexible support strap around the fixed structure. A first end of the support strap is then passed through an end loop formed with a second end of the support strap. The support strap is tensioned around the fixed structure. The hammock is attached to a selected one of a plurality of spaced-apart strap loops formed along the first end of the support strap.

According to another exemplary embodiment, the method includes attaching first and second ends of the hammock to selected strap loops of respective support straps anchored to spaced-apart fixed structures.

The term "hammock" refers broadly herein to any hanging bed, seat, couch, or other suspended or partially suspended support or sling made of any rigid and/or flexible material including canvas, netted cord, rigid framing or the like. Exemplary hammocks may have cords attached to supports at one or both ends.

BRIEF DESCRIPTION OF THE DRAWINGS

Exemplary embodiments of the present invention will hereinafter be described in conjunction with the following drawing figures, wherein like numerals denote like elements, and wherein:

FIG. 1A is an enlarged fragmentary view showing the multiple-loop first end of the support strap passed through the single-loop second end of the support strap;

FIG. 1B is an enlarged fragmentary view showing an end of the hammock attached to the support strap;

FIG. 3 is an enlarged fragmentary view of a portion of the support strap indicated at box 3 in FIG. 2;

FIG. 4 is an enlarged fragmentary view of a portion of the support strap indicated at box 4 in FIG. 2; and FIG. 5A-5D are sequential views demonstrating application of the exemplary support strap to an upright fixed structure.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
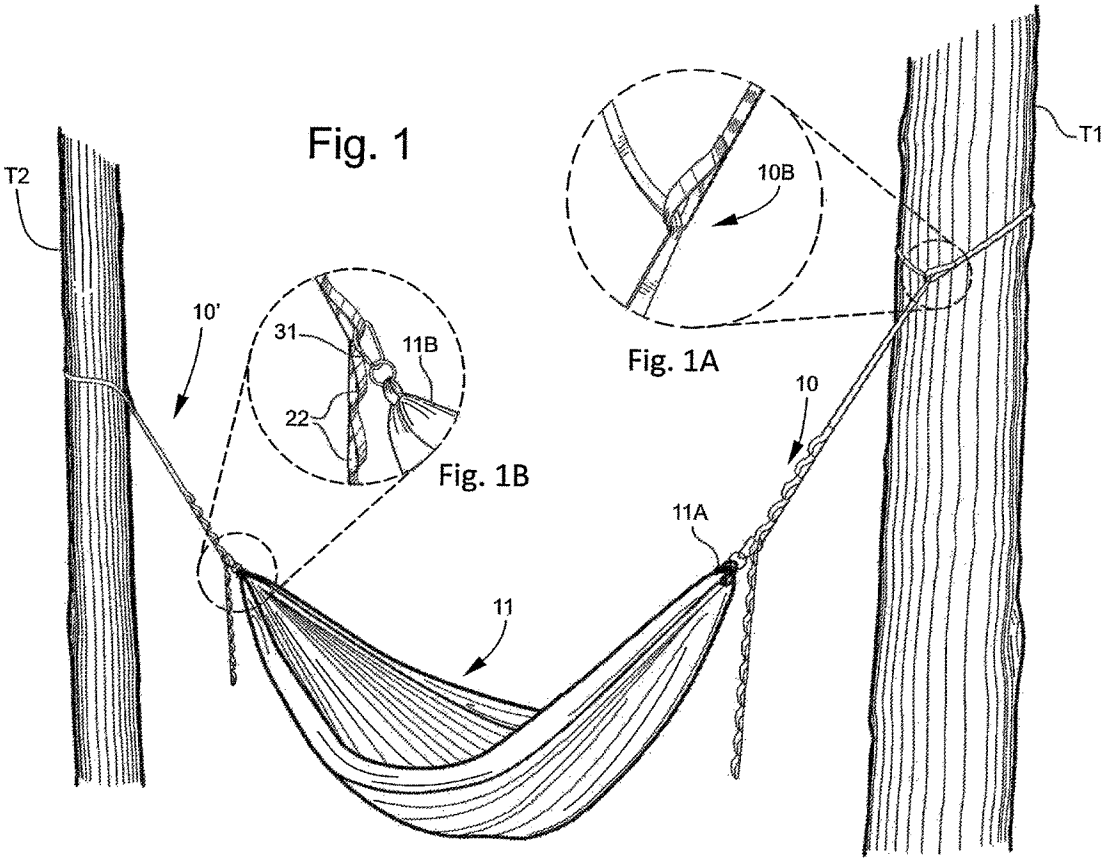
FIG. 1 is an environmental perspective view showing cooperating multiple-loop support straps used for suspending a hammock between spaced-apart trees.

Referring now specifically to the drawings, a multiple-loop support strap according to one exemplary embodiment of the present disclosure is illustrated in FIG. 1, and shown generally at broad reference numeral 10. The exemplary support strap 10 is applicable for hanging one end 11A of a hammock 11 (or the like) from an upright fixed structure, such as tree "T1", and cooperates with a like strap 10' to hang an opposite end 11B of the hammock 11 from a second upright fixed structure, such as "T2", Exemplary methods utilizing the present support straps 10, 10' for suspending the hammock 11 between spaced-apart structures is discussed further below.

Figure 2:
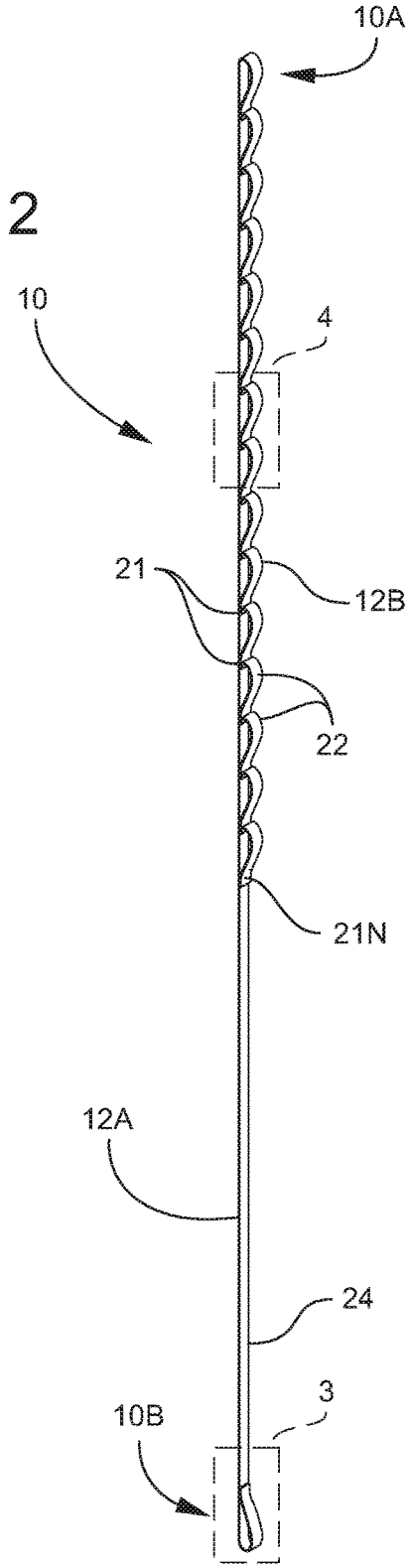
FIG. 2 is an extended perspective view of the exemplary multiple-loop support strap.

Referring to FIGS. 2, 3, and 4, the exemplary support strap 10 comprises an elongated length of flexible flat polyester strap (or webbing) folded upon itself to form first and second overlying strap sections 12A, 12B. The strap sections 12A, 12B are integrally joined together at a first (folded) end of the support strap 10A, while the first strap section 12A extends beyond the overlying second strap section 12B and terminates at an opposite second end 10B of the support strap 10. A free end of the first strap section 12A may be folded on itself and attached using machine-sewn thread 15 (or other means) to form an end loop 16, best shown in FIGS. 2 and 3, at the second end 10B of the support strap 10.

The second strap section 12B is attached using thread 18 (or other means) to the first strap section 12A at longitudinally-spaced attachment points 21. Adjacent attachment points 21 cooperate, as best shown in FIGS. 2 and 4, to form integral loops 22 of the support strap 10. The attachment points 21 in the exemplary strap 10 are substantially equally spaced apart, such that respective openings defined by the multiple of loops 22 are of substantially equal size. A free end of the second strap section 12B is attached to the first strap section 12A at a final attachment point 21N substantially spaced-apart from the single-looped second end 10B of the support strap 10, thereby providing a non-looped length 24 suited for wrapping around the upright fixed structure. The length of the exemplary support strap 10 measured from its first end 10A to the final attachment point 21N may be less than 80 percent of the total length of the support strap 10 measured from end to end, while the non-looped length 24 may be greater than 20% of the total length of the support strap 10. In the exemplary embodiment, the support strap 10 comprises a series of 15 longitudinally adjacent (or spaced) loops 22 formed between the first and second ends 10A, 10B of the support strap 10. The exemplary support strap 10 may be constructed of an 8-ounce, 0.75 inch, flat polyester webbing.

FIGS. 5A-5D demonstrate application of a single support strap 10 to tree "T" for hanging one end of the hammock 11—the opposite end of the hammock 11 being hung to a second spaced-apart tree in the identical manner using a second support strap 10', as demonstrated in FIG. 1. The support strap 10 is first wrapped around the tree "T", as shown in FIG. 5A, and the multiple-loop first end 10A passed through the single-loop second end 10B (FIG. 1A), as indicated by arrow 28 in FIG. 5B. The support strap 10 is then tensioned, as shown in FIG. 5C, by pulling the multiple-loop first end 10A away from the tree "T". Finally, as best shown in FIG. 5D and FIG. 1B, a karabiner 31 (snap hook, S-hook, O-ring, D-ring, and/or other hardware) is used to attach the hammock 11 to a selected one of the longitudinally spaced loops 22, thereby suspending the hammock 11 at a desired elevation above the ground and between the trees. When both support straps 10, 10' are properly applied, as shown in FIG. 1, they can safely carry 400+ pounds of weight. In addition to trees, one or both of the exemplary support straps 10, 10' may be applied to any other fixed (e.g., sturdy) objects or structures including, for example, boat and dock anchors, structural columns and posts, vehicle racks, large rocks, and the like.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A support strap, comprising:

first and second overlying strap sections;

thread for attaching said first and second strap sections together at longitudinally-spaced attachment points, such that said longitudinally-spaced attachment points define a strap loop therebetween; and said second strap section having a length greater than a length of said first strap section between said longitudinally-spaced attachment points, such that said second strap section creates a folded portion at at least one of said attachment points.

2. The support strap according to claim 1, wherein said first strap section is longer than said second strap section.

3. The support strap according to claim 2, wherein a free end of said first strap section is folded and attached to define a single end loop at one end of said support strap.

4. The support strap according to claim 1, wherein said first and second strap sections are constructed of a flat polyester webbing.

5. In combination with a hammock, a support strap adapted for anchoring one end of said hammock to a fixed structure, said support strap comprising:

first and second overlying strap sections;

thread for attaching said first and second strap sections together at longitudinally-spaced attachment points, such that said longitudinally-spaced attachment points define a strap loop therebetween; and said second strap section having a length greater than a length of said first strap section between said longitudinally-spaced attachment points, such that said second strap section creates a folded portion at at least one of said attachment points.

6. The combination according to claim 5, wherein the first strap section of said support strap is longer than said second strap section.

7. The combination according to claim 5, wherein a free end of said first strap section is folded and attached to define a single end loop at one end of said support strap.

8. The combination according to claim 5, wherein said first and second strap sections are constructed of a flat polyester webbing.

* * * * *